US007543722B2

(12) United States Patent
Yates et al.

(10) Patent No.: US 7,543,722 B2
(45) Date of Patent: Jun. 9, 2009

(54) FOAM SOAP GENERATOR AND PUMP

(75) Inventors: James M. Yates, Akron, OH (US); Daniel M. Willis, Clinton, OH (US)

(73) Assignee: Joseph S. Kanfer, Richfield, OH (US)

( * ) Notice: Subject to any disclaimer, the term of this patent is extended or adjusted under 35 U.S.C. 154(b) by 341 days.

(21) Appl. No.: 11/219,363

(22) Filed: Sep. 6, 2005

(65) Prior Publication Data

US 2007/0051748 A1 Mar. 8, 2007

(51) Int. Cl.
*B67D 5/22* (2006.01)

(52) U.S. Cl. ..... 222/135; 222/190

(58) Field of Classification Search ..... 222/135, 222/190, 13.6, 145.5, 145.6, 145.8, 389, 222/394, 129, 321.7, 383.1, 385, 628, 145, 222/5, 136; 239/366–372, 343, 346
See application file for complete search history.

(56) References Cited

U.S. PATENT DOCUMENTS

| | | | | |
|---|---|---|---|---|
| 5,918,771 | A * | 7/1999 | van der Heijden | 222/136 |
| 6,446,840 | B2 * | 9/2002 | Ophardt et al. | 222/190 |
| 2002/0070238 | A1 * | 6/2002 | Pritchett et al. | 222/189.11 |
| 2005/0115988 | A1 * | 6/2005 | Law et al. | 222/145.5 |

* cited by examiner

*Primary Examiner*—Lien T Ngo
(74) *Attorney, Agent, or Firm*—Renner, Kenner, Greive, Bobak, Taylor & Weber

(57) ABSTRACT

A foam soap generator and pump is provided for receipt by a liquid soap container in a foam soap dispenser. The foam soap generator and pump comprise an air cylinder and a liquid cylinder, integral with each other, and in parallel arrangement. Each receives a respective air and liquid piston, again of integral construction. The pistons are provided with arms having passages therethrough that ultimately bring the liquid and air together under pressure for the generation of foam and extrude of the same through an appropriate screen or open cell foam disk.

4 Claims, 4 Drawing Sheets

FOAM SOAP GENERATOR AND PUMP

TECHNICAL FIELD

The invention herein resides in the art of soap dispensers and, more particularly, to a foam soap generator and pump for receipt by a liquid soap container. More particularly, the invention relates to a foam soap generator and pump operable in both upright and inverted positions, as well as in systems where the soap container and dispensing head are separated and remote from each other.

BACKGROUND OF THE INVENTION

The use of soap dispensers is now widespread, as the awareness for the need of good hand hygiene practices grows. In the past, numerous types of dispensing systems have been known, including wall mount, counter mount, under the counter, and the like. Typically, these soap dispensers have been of a nature to dispense a predetermined amount of liquid soap upon actuation. Over the past decade or so, interest has grown in foam soap dispensers, in which the soap is dispensed in the form of a foam, comprising a uniform mixture of air and liquid soap to form a substantially homogenous foam.

While various foam soap generators and pumps have previously been known, they have typically been of a complex nature, and have often sacrificed reliability and operability for cost. Typical pumps have often included concentric or axially aligned air and liquid chambers and complex valving methodologies to achieve the desired foam generation and dispensing. In general, previously known systems have also failed to produce a high quality foam of uniform consistency, have not been given to implementation in various orientations, have been difficult to manufacture and assemble, and have generally not been given to ease of adaptability to the dispensing of various doses of soap.

Indeed, in the prior art, foam has been generated by activating two commercially available pumps tied together to deliver air and liquid into a foam producing cartridge. Others have attempted to cylindrically stack liquid and air pumps to deliver a combination of the two, in the form of a prefoam or otherwise, to a foam generating stage. Other prior art has employed the use of ball and spring valves that typically only work in one orientation, requiring significant design change for adaptation for use in another orientation. The prior art has also sought to accommodate the dispensing of various doses of soap by changing either the piston size or the stroke thereof.

DISCLOSURE OF THE INVENTION

In light of the foregoing, it is a first aspect of the invention to provide a foam soap generator and pump in which both the liquid soap and air cylinders as well as the associated pistons are arranged in side by side relationship.

Another aspect of the invention is the provision of a foam soap generator and pump in which duckbill check valves, or other check valves of similar simplistic structure, are implemented to allow the pump to function in any orientation and to reduce dripping and leaking of the pump when inverted in a dispenser.

Still further aspects of the invention are the provision of a foam soap generator and pump which is simplified for production over those of the prior art.

Still another aspect of the invention is the provision of a foam soap generator and pump which is capable of producing quality foam of uniform consistency.

Yet a further aspect of the invention is the provision of a foam soap generator and pump that accommodates liquid intake from the bottom of the soap bottle or container.

Still a further aspect of the invention is the provision of a foam soap generator and pump having multiple possible placements of a valve positioned in the liquid pump path to allow for variable doses.

The foregoing and other aspects of the invention which will become apparent as the detailed description proceeds are achieved by a foam soap generator and pump for receipt by a liquid soap container, comprising: an air cylinder adapted for fixed receipt by the container; a liquid cylinder adapted for fixed receipt by the container; an air piston reciprocatingly received by said air cylinder; a liquid piston reciprocatingly received by said liquid cylinder; wherein said air and liquid pistons have respective air and liquid passages interconnecting with each other to form an outlet passage; and a porous member in receiving communication with said outlet passage.

Still other aspects of the invention are attained by a foam soap pump for interconnection with a liquid soap container, comprising: an air cylinder; a liquid cylinder integral with said air cylinder; an air piston reciprocatingly received by said air cylinder; a liquid piston reciprocatingly received by said liquid cylinder, said liquid piston being integral with said air piston; an outlet nozzle; an air passage extending through said air piston between said air cylinder and said outlet nozzle; and a liquid passage extending through said liquid piston between said liquid cylinder and said outlet nozzle, said air and liquid passages joining at a point adjacent said outlet nozzle.

Yet other aspects of the invention are attained by a foam soap pump for interconnection with a liquid soap container, comprising: an integrally formed air chamber and liquid chamber; an integrally formed air piston and liquid piston reciprocatingly received by said air and liquid chambers; a foam soap outlet; an air passage extending through said air piston from said air chamber to said foam soap outlet; a liquid passage extending through said liquid piston from said liquid chamber to said foam soap outlet; and wherein said air passage is absent a valve and said liquid passage is valved.

DESCRIPTION OF DRAWINGS

For a complete understanding of the structure and techniques of the invention, reference should be made to the following detailed description and accompanying drawings wherein.

BEST MODE FOR CARRYING OUT THE INVENTION

Figure 1:
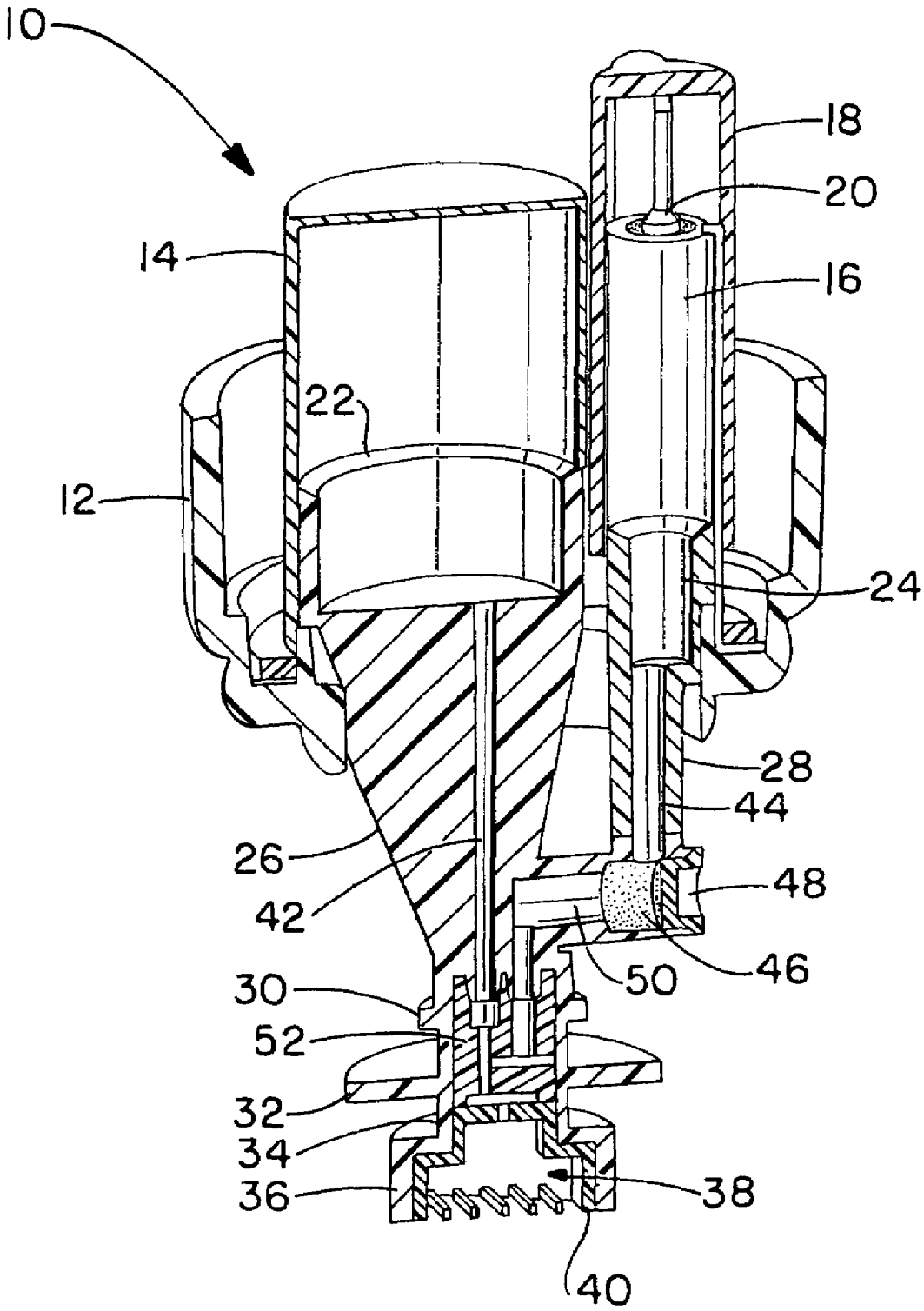
FIG. 1 is a cross sectional view of a foam soap generator and pump made in accordance with the invention.

Referring now to the drawings and more particularly to FIG. 1, it can be seen that a foam soap generator and pump made in accordance with the invention is designated generally by the numeral 10. The assembly 10 includes a cap or collar 12 adapted to be received by a bottle, container, cartridge or the like containing liquid soap to be converted into foam at dispensing. Alternatively, for a counter mounted unit, the collar 12 could be adapted to secure the assembly 10 to a counter, with extend tubes to a bottle, container or the like. An air cylinder or chamber 14 is received by or is integral with the cap 12 such as to be fixedly retained with respect to the liquid soap container when the cap 14 is in place. Similarly, a liquid cylinder or chamber 16 is provided in parallel orientation with the air cylinder 14, and is similarly adapted for fixed positioning with respect to the liquid soap container when the cap 12 is engaged.

A cover 18 extends over the end of the cylinder 16 and communicates with the interior of the liquid soap container to allow entry of liquid soap into the cylinder 16 though an appropriate umbrella valve 20, operating as a check valve. It will be appreciated that the cover 18 has an opening therein to allow for the communication of the liquid soap into the cylinder 16, and the cover 18 is adapted to receive an extension tube or the like to reach to the farthest position of the soap container to effect full depletion of the liquid soap therefrom. In the inverted position, the tube would be bent back upon itself, while in an upright position the tube would simply be substantially straight and elongated.

An air piston 22 is received within the air cylinder 14, and a liquid piston 24 is received within the liquid cylinder 16. The pistons 22, 24 are preferably cup-shaped, and are provided with appropriate seals at the interface between the piston 22, 24 and associated cylinder 14, 16. Those skilled in the art will appreciate that a friction fit is preferably attained, accommodating reciprocating movement of the pistons 22, 24 within the cylinders 14, 16. As shown, the cup shaped pistons 22, 24 extend from respective arms 26, 28, which are preferably integral with each other and with the pistons themselves.

At the dispensing end of the generator and pump 10 is a top collar 30 spaced apart from a bottom collar 32, the two providing means for receipt of a lever actuator or the like of the dispenser in which the generator and pump assembly 10 is employed. A neck 34 extends downwardly from the bottom collar 32 to a housing 36 defining a cavity 38 therein. The cavity 38 is adapted to receive meshes, screens, open cell foam, or other permeable material to serve to smooth and homogenize the foam passing therethrough and produced thereby. A retaining grid and insert 40 is received by the housing 36 and about the perimeter of the cavity 38 to retain the open cell foam or the like therein.

An air conduit 46 is provided in the arm 26 and communicates with the cavity defined between the air piston 22 and the interior of the air cylinder 14. Similarly, a liquid conduit 28 communicates with the cavity defined between the liquid piston 24 and the liquid cylinder 16. A check valve 46, to be described later herein, is retained by a plug 48 at an elbow between the liquid conduit 44 and transition liquid conduit 50, as illustrated.

Figure 2:
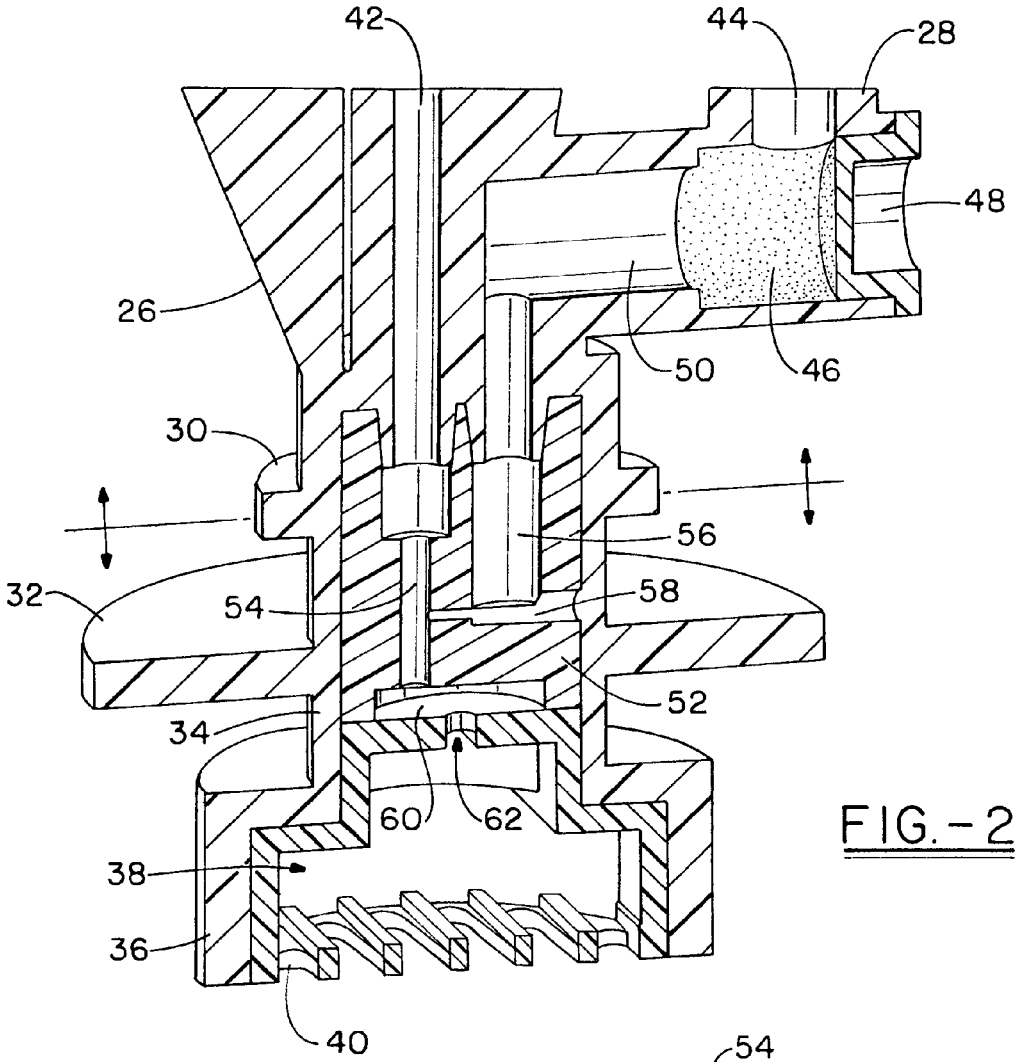
FIG. 2 is an enlarged cross sectional view of the intersection of the air and liquid passages and the cavity for receiving a permeable member for generating foam in accordance with the invention.

As best shown in FIG. 2, an insert 52 is received within the neck 34 in a bore defined by the legs 26, 28. The insert 52 includes an air passage 54 adapted to communicate with the air passage 42, and the liquid passage 56 positioned and adapted to communicate with the liquid passage 50. A cross passage 58 extends between the air and liquid passages 54, 56, to allow the introduction of soap into the air steam upon actuation, for generation of a prefoam or the like within a chamber 60 which then passes through an aperture 62 to the cavity 38 where the foam is refined as by the use of a disk of open cell foam, spaced apart screens, or the like.

Figure 3:
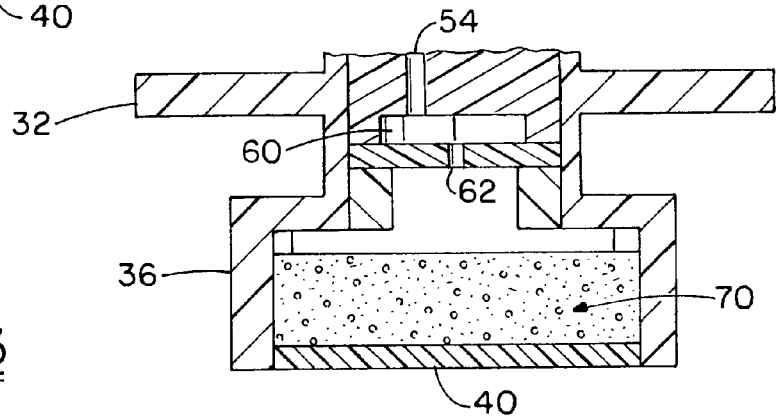
FIG. 3 is a cross sectional view of the final foam generating stage of the invention, showing the use of an open cell foam for purposes of foam generation.
Figure 4:
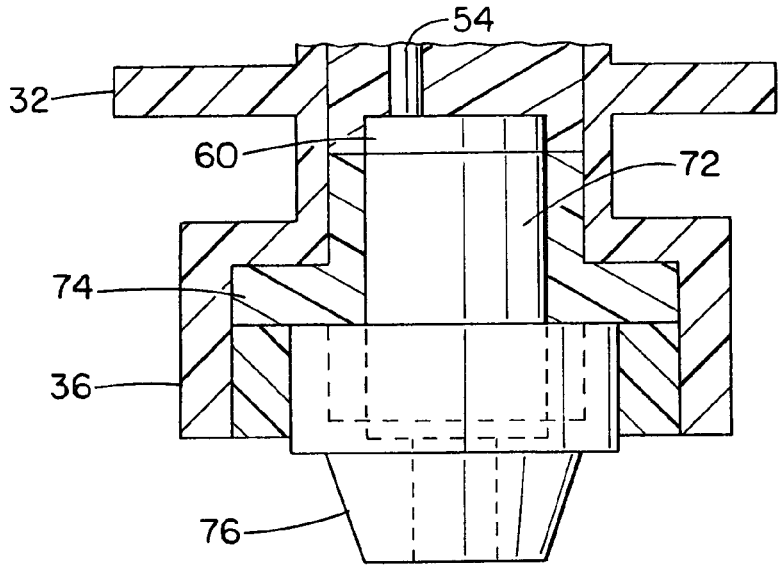
FIG. 4 is a cross sectional view of the final stage of the foam generating device of the invention, showing a cartridge having a pair of diametrically opposed screens therein for generating the foam.

With reference now to FIG. 3, it can be seen that the embodiment of the invention shown therein employs a disk of open cell foam 70 within the chamber 38 and retained by the grid insert structure 40 for purposes of refining and polishing the foam generated by the generator and the pump assembly 10. In FIG. 4, yet another embodiment for generating such foam is demonstrated, where it is shown that a cartridge 72 is received within a cartridge holder 74 and maintained within the housing 36, with an appropriate nozzle 76 being attached thereto. The screen cartridge 72 employs a pair of spaced apart screens or meshes, at opposite ends thereof, for purposes of finishing the foam generated by the generator and pump 10.

Figure 5:
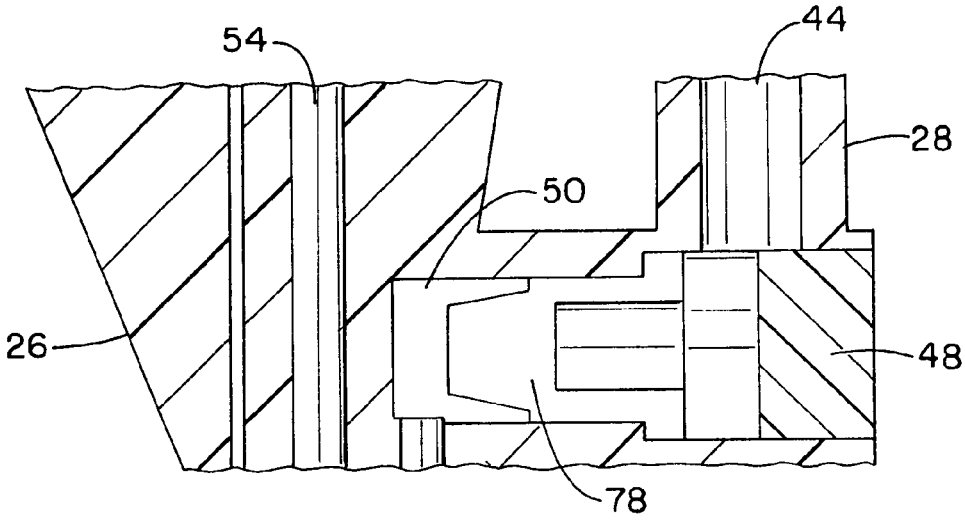
FIG. 5 is a cross sectional view of a duckbill valve used adjacent an elbow in the liquid flow path of the invention.
Figure 6:
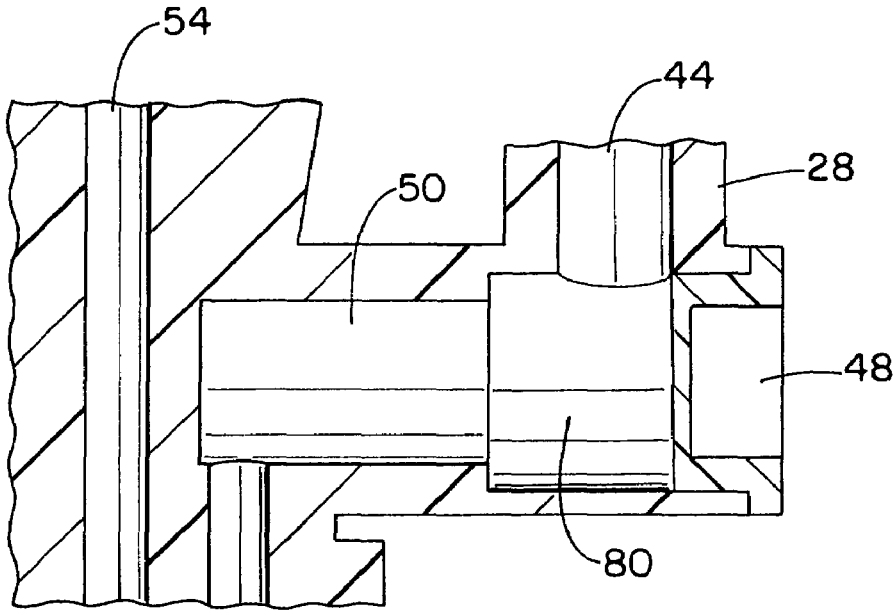
FIG. 6 is a partial cross sectional view showing a cylindrical flexible tube valve, employed as a check valve at the elbow in the liquid flow path of the invention.

With reference to FIG. 5, it can be seen that the check valve 46, shown illustratively in FIG. 1, is shown as a duckbill check valve 78, retained in the liquid conduit 44, 50 by an appropriate plug 48. Alternatively, as shown in FIG. 6, a deflectable tubular plug 80 may be employed at the elbow between the liquid conduits 44, 50 to serve as a check valve. Again, a plug 48 retains the valve 80 in its place. It will be appreciated that when liquid flows from the liquid cylinder 16 through the valve 80, the tubular valve deflects to allow the liquid to pass through the conduit 44, through the tube 80 and then through the conduit 50. In the embodiment of FIG. 5, the liquid passing from the liquid cylinder 16 passes through the conduit 44 and the elbow interconnecting the conduit 50, thence through the duckbill check valve 78 to the conduit 50. Of course, the check valves 78, 80 are of such nature as to prevent reverse flow of such liquid.

In use, the assembly 10 is appropriately fitted to a container of liquid soap, either in an upright or inverted position. Upon downward stroke of the pistons 22, 24, air is drawn from the ambient, through the foam generator member maintained within the cavity 38, through the aperture 62 and chamber 60, thence through the air passages 55 and 42 and into the enlarging cavity between the piston 42 and the interior walls of the cylinder 14. This also provides a "suck back" feature for the pump, withdrawing any residual foam that might otherwise be at the dispensing nozzle 76 back into or toward the air chamber 14. This prevents drips, condensation, and the like.

On the same downward stroke, liquid cylinder 16 is filled with liquid soap drawn from the soap container and through the umbrella valve 20 to await a dispensing operation. When the lever of the dispenser is actuated, that lever, interconnected to the pump 10 as at the collars 30, 32, forces the pistons 22, 24 upwardly into their respective cylinders 14, 16, with the resultant pressure forcing air through the passages 42, 54 and liquid soap through the passages 44, 50, and the check valve 46 interposed therebetween. Of course, upon actuation, the umbrella valve 20 has sealed, preventing any escape of liquid from the cylinder 16 back into the liquid container. The liquid soap passes through the cross passage 58 where it is blended with the air 54 to form a prefoam within the cavity 60, from which it is emitted through the aperture 62 and through an appropriate finishing member of open cell foam 70 or screen cartridges 72. Upon release, the spring biased lever of the dispenser forces the pistons 22, 24 downwardly, to expand the associated air and liquid chambers 14, 16 to replenish them as described above, to await the next dispensing cycle.

Those skilled in the art will readily appreciate that the amount of liquid soap converted to foam is dependent upon the stroke of the pistons 22, 24, and particularly the liquid piston 24. The dose dispensed is further defined by the cavity established between the check valves 20, 46, such being the maximum volume of soap available for dispensing on any dispensing cycle. Accordingly, by adjusting that size, stroke or positioning, the dose of foam can be tailored as desired.

In accordance with the invention, it is particularly preferred that the pistons 22, 24 and associated arms 26, 28, as well as the collars 30, 32 and housing 36 be of integral construction, with the plug 52 being provided to accommodate the desired interconnection of the flow paths of the liquid and air immediately before the open cell foam disk or screen cartridge. It is similarly desirable that the cylinders 14, 16 be of integral side by side construction, as shown, and that the same be either fixedly secured by, or integral with, the cap 12. Of course, all of the elements of the invention, apart from the check valves mentioned, can be molded of appropriate plastic or the like.

Figure 7:
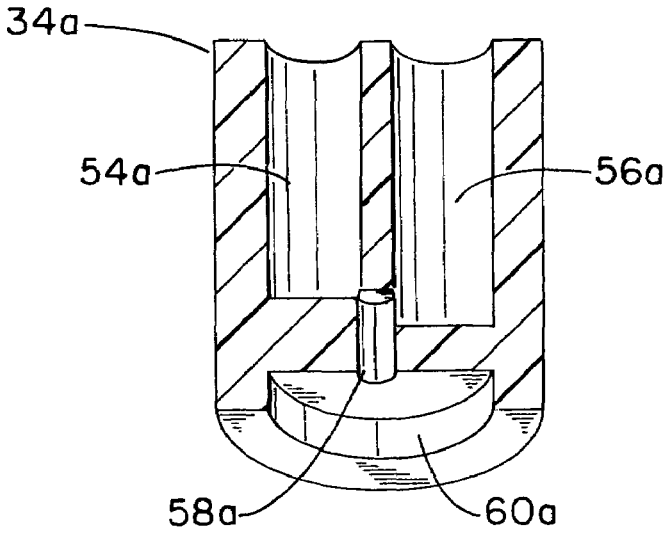
FIG. 7 is a cross sectional view of a modified integral neck portion for the foam soap generator and pump according to the invention.

This structural modification is shown in FIG. 7, wherein an integrally molded neck portion is designated by the numeral 34*a*. Of course, as with the neck portion 34, appropriate top and bottom collars 30, 32 (not shown) would be included. Of particular importance here, is the fact that with the neck portion 34*a* being of solid integral construction, the appropriate passages and cavities can be integrally formed or molded therein. As illustrated, the air passage 54*a* and liquid passage 56*a* extend axially in the neck portion 34*a* and are interconnected by an axial passage 58*a*, which provides for receipt of both air and liquid from the respective passages 54*a* and 54*b* upon compressive actuation of the air and liquid pistons 22, 24. The air and liquid are forced under compression through the axial passage 58*a* into the chamber 60*a*, where a prefoam is generated for extrusion or finishing through a screen cartridge or open cell foam member, as the case may be. In any event, it will be readily appreciated that the axial presentation of the passages 54*a* and 56*a* accommodate communication through an intersecting axial passage 58*a* to the chamber 60*a*, obviating the need for the insert 52.

Thus it can be seen that the objects of the invention have been satisfied by the structure presented above. While in accordance with the patent statutes only the best mode and preferred embodiments of the invention have been presented and described in detail, the invention is not limited thereto or thereby. Accordingly, for an appreciation of the true scope and breadth of the invention reference should be made to the following claims.

What is claimed is:

1. A foam soap pump for interconnection with a liquid soap container, comprising:

an air cylinder;

a liquid cylinder having a first check valve therein, said liquid cylinder being integral with said air cylinder;

an air piston reciprocatingly received by said air cylinder;

a liquid piston reciprocatingly received by said liquid cylinder, said liquid piston being parallel to, offset from, and integral with said air piston;

an outlet nozzle;

an unvalved air passage extending through said air piston between said air cylinder and said outlet nozzle;

a liquid passage having a second check valve therein, said liquid passage extending through said liquid piston between said liquid cylinder and said outlet nozzle, said air and liquid passages joining as a single combined passage; and a permeable member interposed between said outlet nozzle and said single combined passage.

2. The foam and soap pump according to claim 1, wherein said air and liquid passages join to form said single combined passage at a neck region of said integral air and liquid pistons.

3. The foam soap pump according to claim 1, wherein said second check valve is received within an elbow in said liquid passage, said second check valve comprising a deflectable tubular member.

4. The foam soap pump according to claim 1, further comprising a cap in operative securing engagement with said air and liquid cylinders, said cap being adapted to secure the soap foam pump to the liquid soap container.

* * * * *